US006186345B1

(12) United States Patent
Robertson

(10) Patent No.: US 6,186,345 B1
(45) Date of Patent: Feb. 13, 2001

(54) STACKABLE SHIPPING CASE HAVING GRAVITY FEED TRACKS

(75) Inventor: James David Robertson, Atlanta, GA (US)

(73) Assignee: Display Industires, LLC., Smyrna, GA (US)

( * ) Notice: Under 35 U.S.C. 154(b), the term of this patent shall be extended for 0 days.

(21) Appl. No.: 09/176,675

(22) Filed: Oct. 21, 1998

(51) Int. Cl.[7] ..... A47F 1/04

(52) U.S. Cl. ..... 211/59.2; 211/128.1; 211/184; 220/643

(58) Field of Search ..... 211/59.2, 59.4, 211/126.2, 128.1, 184, 194; 206/201; 220/643, 644

(56) References Cited

U.S. PATENT DOCUMENTS

| | | | | |
|---|---|---|---|---|
| 1,418,324 | | 6/1922 | O'Connor | 211/128 |
| 1,704,118 | | 3/1929 | Babcock | 217/36 |
| 3,053,397 | | 9/1962 | Bliss | 211/126 |
| 3,097,746 | | 7/1963 | Handler et al. | 211/126 |
| 3,203,553 | * | 8/1965 | Pendergrast, Jr. et al. | 211/59.2 |
| 3,704,792 | | 12/1972 | Wiese | 211/126 |
| 3,762,594 | | 10/1973 | Utz | 220/21 |
| 3,841,519 | | 10/1974 | Stromberg | 220/83 |
| 3,905,484 | | 9/1975 | Dean et al. | 211/184 |
| 3,908,566 | | 9/1975 | Frazelle et al. | 108/153 |
| 3,970,199 | | 7/1976 | Marschak | 211/128 |
| 4,056,295 | | 11/1977 | Downing | 312/107 |
| 4,105,126 | * | 8/1978 | Deffner et al. | 211/59.2 |
| 4,228,903 | | 10/1980 | Eckert | 211/49 |
| 4,356,923 | * | 11/1982 | Young et al. | 211/184 X |
| 4,550,837 | | 11/1985 | Simmons | 211/126 |
| 4,598,828 | | 7/1986 | Young et al. | 211/59.2 |
| 4,619,371 | * | 10/1986 | Rehrig | 220/643 |
| 4,651,883 | | 3/1987 | Gullett et al. | 211/59.2 |
| 4,690,287 | | 9/1987 | Fershko et al. | 211/49.1 |
| 4,785,943 | | 11/1988 | Deffner et al. | 211/59.2 |
| 4,785,945 | * | 11/1988 | Rowse et al. | 211/59.2 |
| 4,801,025 | | 1/1989 | Flum et al. | 211/128 |
| 4,899,874 | | 2/1990 | Apps et al. | 206/201 |
| 5,148,942 | | 9/1992 | Snook | 220/533 |
| 5,351,838 | * | 10/1994 | Flum | 211/59.2 |
| 5,379,905 | * | 1/1995 | Bustos et al. | 211/59.2 |
| 5,452,803 | | 9/1995 | Stromberg | 206/507 |
| 5,586,687 | | 12/1996 | Spamer et al. | 221/298 |
| 5,788,090 | * | 8/1998 | Kajiwara | 211/59.2 |

* cited by examiner

*Primary Examiner*—Bruce A. Lev
(74) *Attorney, Agent, or Firm*—John L. James

(57) ABSTRACT

A stackable case has a base wall, a pair of opposed side walls and a back wall which are molded together to form a unitary crate structure with an open top and an open front. The open top and open front are designed to provide access to the articles to be accommodated in the crate structure. The base wall is arranged so that its upper surface provides a low friction, article-carrying floor inclined downwardly toward the open front. Partitions are provided to divide the floor area into two or more parallel tracks for receiving articles in rows. The tracks extend forward from the back wall so that the articles in each track are carried by the floor and are allowed to gravity feed toward the open front. A front stopper is provided at the open front for engagement with the leading article in each track to prevent the leading article from falling out of the crate structure. The lower edges of the side walls are arranged to cooperate with a lower adjacent like case so that the cases are permitted to be stacked one on the other.

17 Claims, 5 Drawing Sheets

STACKABLE SHIPPING CASE HAVING GRAVITY FEED TRACKS

BACKGROUND OF THE INVENTION

The present invention relates generally to merchandising devices and, more particularly, to a shipping case which can serve not only as a transport and storage case but also as a merchandising display unit.

Conventional shipping cases of the above mentioned type are disclosed, for example, in U.S. Pat. Nos. 3,762,594 and 3,841,519. These shipping cases are usually arranged for stacking. In a stacked position, they can form a suitable storage and display rack providing a good visibility of the contents such as bottles, cans or boxes arranged in rows, and permitting the contents to be removed through one or more side openings formed for each case. Cases of this type have been found of utility since they can dispense with the process for transferring the contents to one or more separate display racks, which would otherwise be required at the point of sales. However, as the contents of the stacked cases are removed first from the front rows adjacent to the side openings, it is still annoying duties to those who attend to the stacked cases to rearrange the remaining contents so that the contents are presented with tidy front rows.

What is needed, therefore, are shipping cases which can be stacked to form a storage and display rack that is easy to attend to. Such shipping cases and a rack should be capable of automatically rearranging the contents or articles so that the articles are displayed always in tidy rows.

SUMMARY OF THE INVENTION

According to the invention in one form, a stackable shipping case is provided with a slanted floor and one or more partitions to provide a gravity feed display unit. The stackable case comprises a base wall, a pair of opposed side walls and a back wall which are molded together to form a unitary crate structure with an open top and an open front. These open top and open front are designed to provide access to the articles to be accommodated in the crate structure. The base wall is arranged so that its upper surface provides a low friction, article-carrying floor inclined downwardly toward the open front. The partitions are formed on the floor and divides the floor area into two or more parallel tracks for receiving articles in rows. These tracks extend forward from the back wall so that the articles in each track are carried by the floor and are allowed to gravity feed toward the open front along the respective track. A front stopper is provided at the open front for engagement with the leading article in each track to prevent the leading article from falling out of the crate structure until its removal is desired. Further, the lower edges of the side walls are arranged to cooperate with a lower adjacent like case so that the case is permitted to be stacked on the lower adjacent like case.

In a preferred embodiment, the floor is inclined with respect to a plane defined by the upper edges of the side walls. Each side wall may be formed with a hand aperture to define a hand grip near the upper edge of each side wall.

In another preferred embodiment, the stackable case further comprises an upper front cross member extending between the side walls so that the lower edge of the upper front cross member, the front edges of the side walls and the top of the front stopper cooperatively define the open front through which the contents of the case may be removed.

In still another preferred embodiment, the stacking means comprises upper and lower engaging means. The upper engaging means comprises the upper edges of the side walls whereas the lower engaging means comprises the lower edges of the side walls. The lower edges of the side walls are arranged to engage the upper engaging means of the lower adjacent like case. The lower engaging means may further comprise a pair of side ribs projecting downward respectively from the lower edges of the side walls to engage the side walls of the lower adjacent like case, respectively. In this embodiment, the stackable case may further comprise an upper front cross member extending between the side walls. In such a case, the upper engaging means further comprises the upper edge of the upper front cross member and the upper edge of the back wall. The lower engaging means may further comprise a pair of front and rear ribs projecting downward from the front and rear edges of the base wall to engage the upper front cross member and the back wall of the lower adjacent like case.

In a further preferred embodiment, the front stopper comprises a lower front cross member extending between the side walls. In this embodiment, the one or more partitions may extend between the back wall and the lower front cross member. The vertical size of each partition may be less than that of the side walls.

In a still further preferred embodiment, the back wall of the stackable case is formed with one or more rear openings for receiving respective portions of the leading articles in a longitudinally adjacent like case (i.e., a "rear case") placed behind the back wall in a front-to-back contacting relationship with the stackable case (i.e., the "front case"). The number of such openings may correspond to that of the tracks in each case, and the rear openings may be located at the rear ends of the tracks in the front case, respectively. The rear openings allow the front and rear cases to be placed together in a directly contacting relationship even though some portions of the leading articles in each case tend to project forwardly though the respective open front. In this embodiment, the front case may comprise a plurality of rear arresting members joined to the back wall such that each arresting member transversely spans the respective rear opening to engage the leading articles in the rear case. The arresting members prevents the leading articles in the rear case from leaning against the trailing articles in the front case so that the trailing articles in the front case are free of pressure of the articles in the rear case.

The present invention in another form provides a combination comprising a shipping case and its contents, i.e., a plurality of upright articles such as bottles, cans or boxes in their upright position. The shipping case in this form is virtually identical to that of the first form except that the case of the second form is further defined as having the side walls of a vertical size substantially greater than the vertical size of the upright articles.

The present invention in still another form provides a modular merchandising device comprising a plurality of shipping cases stacked one on top of another to form a display rack. Each shipping case in this form is virtually identical to the case of the first form.

The objects and advantages of the present invention should be apparent from the above and following description, the accompanying drawings and the appended claims.

DETAILED DESCRIPTION OF THE PREFERRED EMBODIMENTS

Figure 1:
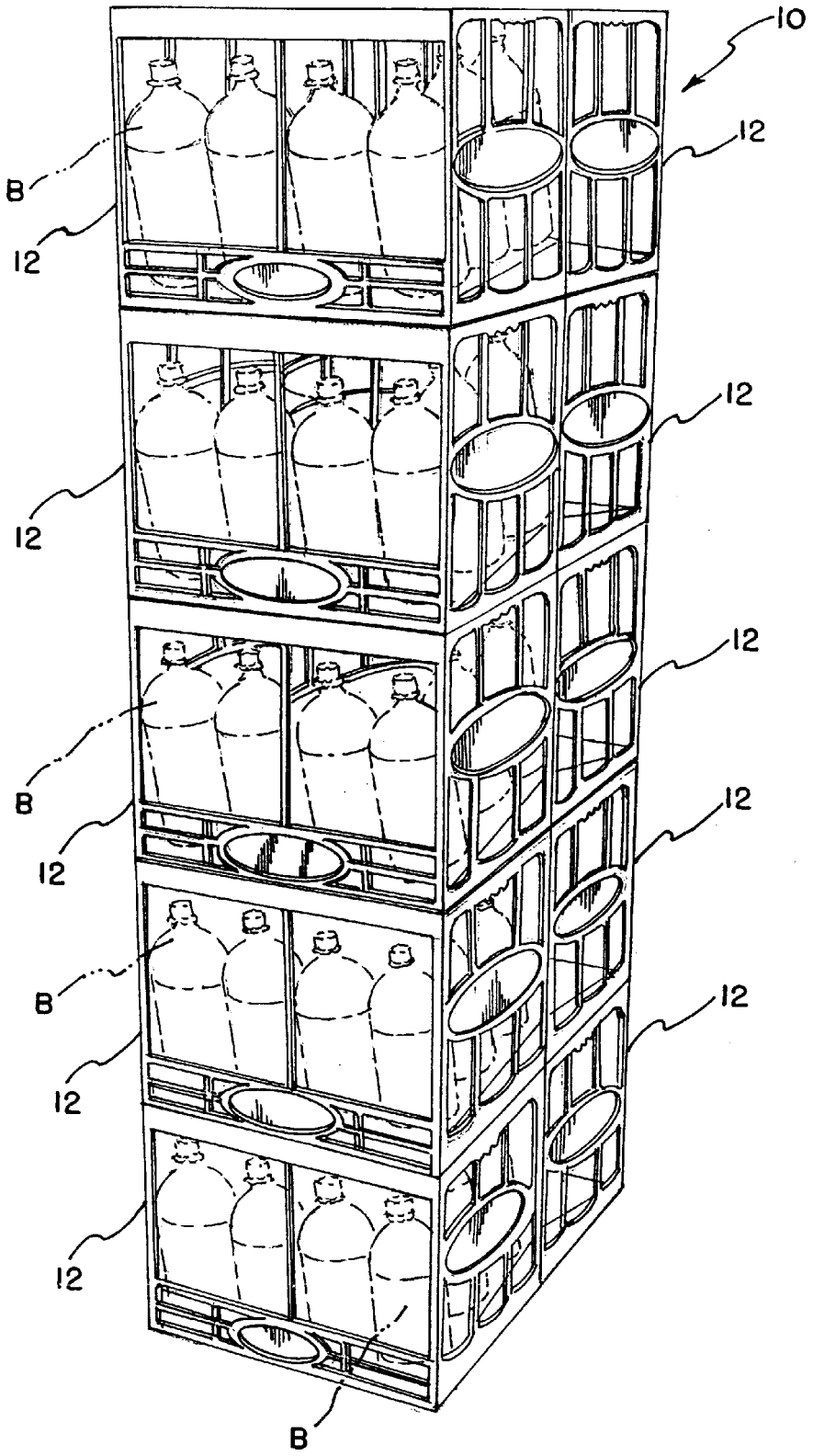
FIG. 1 is a perspective view of a modular merchandising device or display rack according to the present invention, showing the bottles in phantom lines.

FIG. 1 illustrates a modular merchandising display rack according to the invention. The illustrated rack 10, more particularly, is designed to serve as a double-sided gravity feed rack for merchandising articles "B" such as bottled or canned drink products which may be accessed from the opposite sides of the rack. The rack 10 is assembled from a plurality of like shipping cases 12 arranged in two stacks each including five cases 12 stacked one on another. The two stacks of cases are placed next to each other so that the cases 12 in one of the stacks are in a back-to-back contacting relationship with those in the other stack. The number of the stacks and that of the cases 12 in each stack may be determined by different factors including the available floor space, the size of each case 12, the location where the rack is installed and the like, and they are not limited to those shown in FIG. 1.

Figure 2:
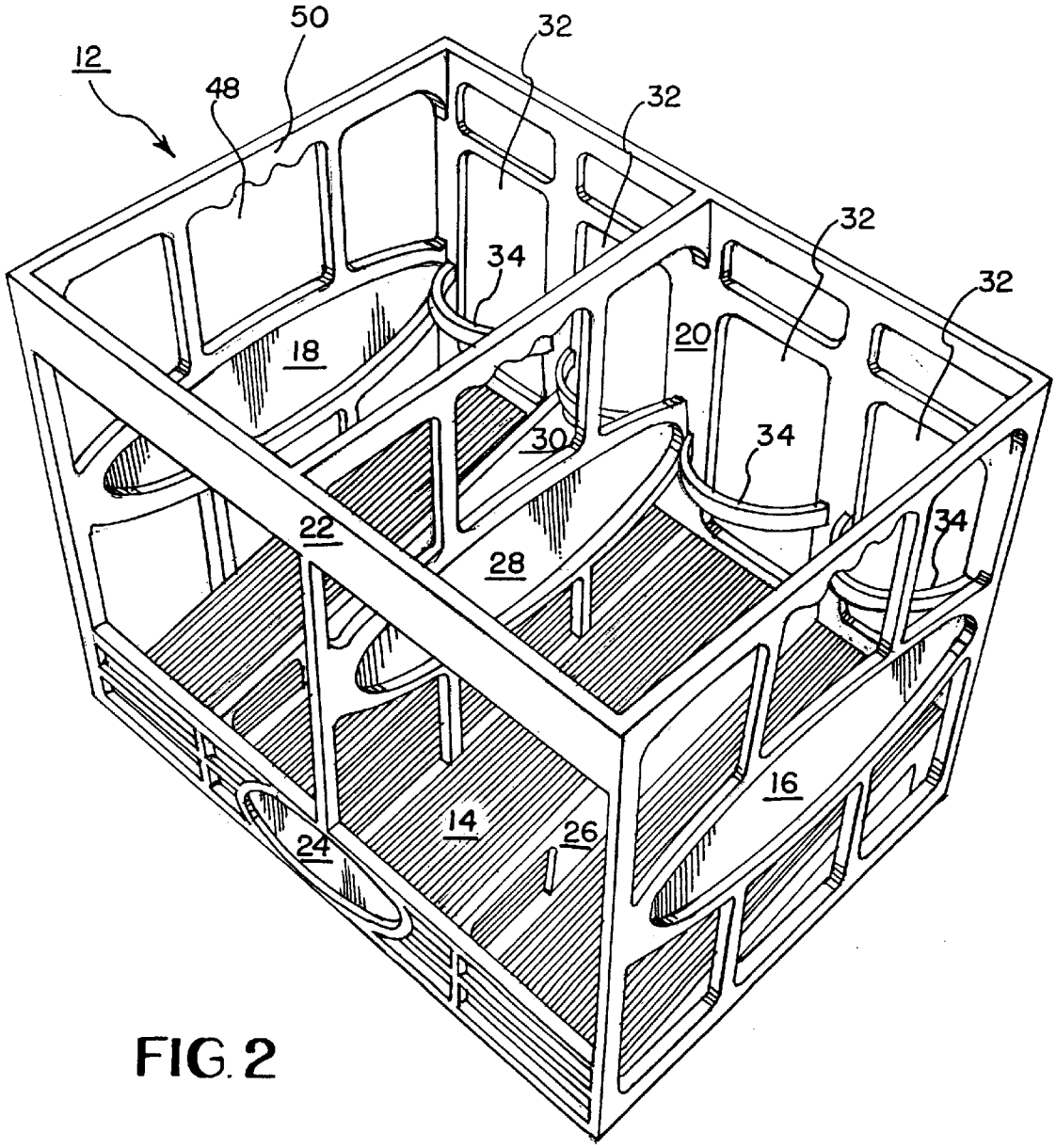
FIG. 2 is a top, right and front perspective view of one of the shipping cases used to form the rack in FIG. 1.
Figure 3:
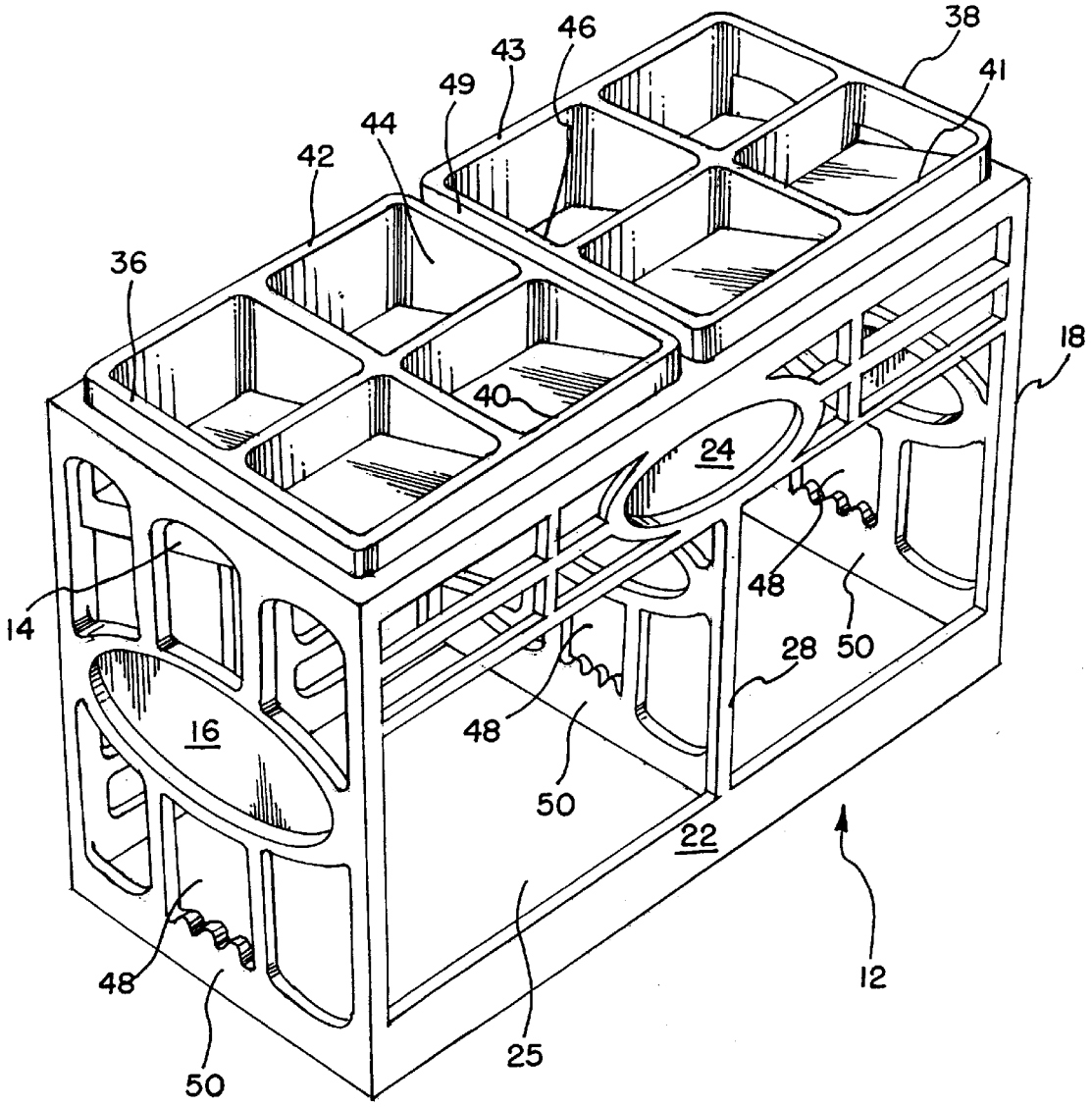
FIG. 3 is a bottom, right and front perspective view of the shipping case in FIG. 2.

FIGS. 2 and 3 illustrate one of the shipping cases 12 used in the display rack 10. As all the cases 12 are virtually identical in size and structure, only one case is described hereinafter. The case 12 is preferably formed of moldable material such as plastic or metal (e.g., aluminum and aluminum compound such as anodized aluminum), and more preferably of thermoplastic resin. As illustrated, the case 12 has a base wall 14, a pair of opposed side walls 16 and 18 and a back wall 20. These case walls 14, 16, 18 and 20 are molded together to form a unitary crate structure having an open top and an open front. The side walls 16 and 18 are interconnected near their lower edges by the base wall 14 and at their rear edges by the back wall 20. The rear edge of the base wall 14 is joined to the back wall 20. Each case wall is apertured in a latticework fashion in order to form a lightweight unit, to save material and to enhance the visibility of the articles "B" within the case 12.

Figure 4:
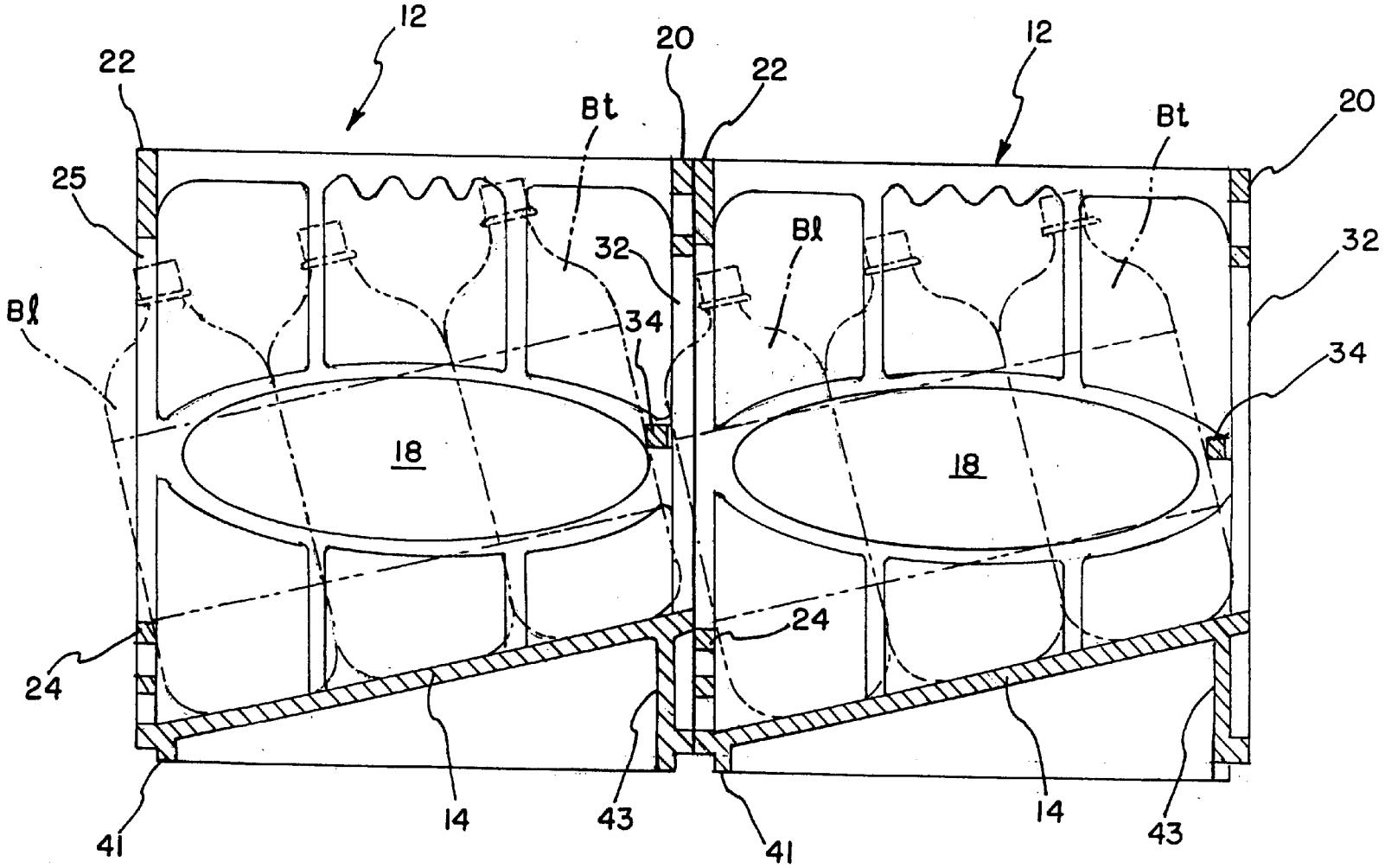
FIG. 4 is a vertical cross section of two shipping cases each identical to that in FIG. 2 and placed in a front-to-back contacting relationship.

As best shown in FIG. 4, the base wall 14 is inclined with respect to a plane defined by the respective lower edges of the side and back walls 16, 18 and 20 so that the upper surface of the base wall 14 provides an article-carrying floor tilted downwardly toward the front edge of the base wall 14. The angle of tilt from the horizontal may vary somewhat but such an angle may be about 1 to 20 degrees and preferably about 3.5 to 8 degrees. The angle of tilt in most applications of the invention may be approximately 6 degrees from horizontal. The upper surface of the base wall 14 is formed with a plurality of ribs extending parallel to the side edges of the base wall 14 to minimize friction between the floor and the articles "B" to be carried thereon.

Returning to FIGS. 2 and 3, upper and lower front cross members 22 and 24 are provided to interconnect the front edges of the side walls 16 and 18 and to thereby reinforce the front portion of the crate structure. The upper cross member 22 is disposed at an elevation such that the upper edge of the upper cross member lies in the plane defined by the upper edges of the side and back walls 16, 18 and 20. The lower cross member 24 is disposed adjacent to the front edge of the base wall 14. The member 24 is also apertured or slotted for the same reasons as the case walls 16, 18 and 20. The cross members 22 and 24 define, in cooperation with the side walls 16 and 18, a front opening for providing access to the articles "B" to be accommodated in the case 12. More particularly, the front opening is defined cooperatively by the lower edge of the upper front cross member 22, the front edges of the side walls 16 and 18 and the top edge of the lower front cross member 24. The distance between the upper and lower cross members 22 and 24 should be great enough to allow the articles "B" in an upstanding condition to go through the front opening. Such a distance is not necessarily greater than the vertical size of the articles "B" but may be somewhat less than the vertical size of the article "B".

As best shown in FIG. 2, the floor area between the side walls 16 and 18 is divided by partitions 26, 28 and 30 into a plurality of parallel tracks for receiving the articles "B" in rows. The partitions 26, 28 and 30 are upstanding from the base all 14 and extend all the way between the lower front cross member 24 and the back wall 20. The vertical size of the partitions 26 and 30 is considerably less than that of the side walls 16 and 18. However, the medial partition 28 extend to the level of the upper edges of the front cross member 22 to connect between the member 22 and the back wall 20. The medial partition 28 is also apertured in the same fashion as the side walls 16 and 18. The tracks extend forward from the back wall 20. The articles "B" in each track are disposed in their upright position and are carried by the tilted floor. Thus, they have a natural tendency to automatically slide downwardly toward the front opening. When a leading article is removed from one of the tracks, the succeeding articles in the track are allowed to gravity feed toward the front opening along the track until the second leading article is arrested by the lower cross member 24. In this sense, the lower cross member 24 serves as a front stopper that is shared by all the tracks to prevent the leading articles from falling out of the crate structure until their removal is desired.

Referring to FIG. 3, the bottom of the case 12 is arranged to cooperate with the top of another case 12 to allow the cases 12 to be stacked one on top of another. More particularly, the lower edges of the side and back walls 16, 18 and 20 and the lower edge of the lower front cross member 24 lie in a plane so that they can rest respectively on the upper edges of the side and back walls and that of the upper front cross member of another case 12. A pair of side ribs 36 and 38 are formed on the lower edges of the side walls 16 and 18 respectively and project downwardly therefrom. A pair of front ribs 40 and 41 project downward from the front edge of the base wall 14 whereas a pair of rear ribs 42 and 43 project downward from the rear edge of the base wall 14 (see FIG. 4). Further, medial ribs 44 and 46 are also formed on the base wall 14 to reinforce the base wall 14 as well as to define a groove 49 therebetween. The front and rear ribs 40 and 42 are interconnected by the side and medial ribs 36 and 44 to form a rectangular engaging frame while the front and rear ribs 41 and 43 are interconnected by the side and medial ribs 38 and 46 to form another rectangular engaging frame. When two cases 12 are stacked one on the other, the two engaging frames of the upper case 12 fit in the open top of the lower case 12 while the upper edge of the medial partition 28 of the lower case 12 is received in the groove 49 of the upper case 12. This allows the side and back walls 16, 18 and 20 of the upper case 12 to be vertically aligned respectively with those of the lower case 12 so that the lower edges of the walls 16, 18, 20 and 24 of the upper case rest on the upper edges of the corresponding walls 16, 18, 20 and 24 of the lower case 12. Thus, the upper case 12 is stabilized on the lower case 12.

The apertures/openings 32 in the back wall 20 differ from those in the other part of the case 12 in that they are arranged to cooperate with the leading articles in another case 12. As best shown in FIG. 2, the openings 32 are located at the rear ends of the tracks, respectively. A plurality of arcuate arresting members 34 are joined to the back wall 20 such that each arresting member 34 transversely spans the respective opening 32. This arrangement with the openings 32 and the arresting member 34 is of utility at the time the case 12 is used as a shipping and storage case. This will be described in the following paragraph in reference to FIG. 4.

In FIG. 4, the shipping case 12 on the right hand side (i.e., the "rear case") is placed immediately behind the back wall of the shipping case 12 on the left hand side (i.e., the "front case") in a front-to-back contacting relationship. As viewed in FIG. 4, the leading article "Bl" such as a two-liter PET bottle in each track tends to project forwardly through the front opening 25 of the respective case 12 due to the inclination of the base wall 14. These projecting portions, such as the shoulder portions of the leading bottles in the rear case 12, are received in the openings 32 of the front case 12 to allow the front and rear cases to be placed in a directly contacting relationship, which shoulder portions would otherwise interfere with the back wall 20 of the front case and would thereby cause increase of the required storage space. The arresting members 34 prevents the leading articles "Bl" in the rear case 12 from leaning against the trailing articles "Bt" in the front case 12 so that the trailing articles "Bt" in the front case 12 are free of pressure of the articles in the rear case 12. Each arresting member 34 is inwardly convexly curved to conform to the curvature of the substantially cylindrical side surfaces of the articles in the rear case 12.

Reference numeral 48 in FIG. 3 designates hand apertures in each of the side walls 16 and 18 and the medial partition 28. Each hand apertures 48 defines a hand grip 50 near the upper edge of the respective wall.

Figure 5:
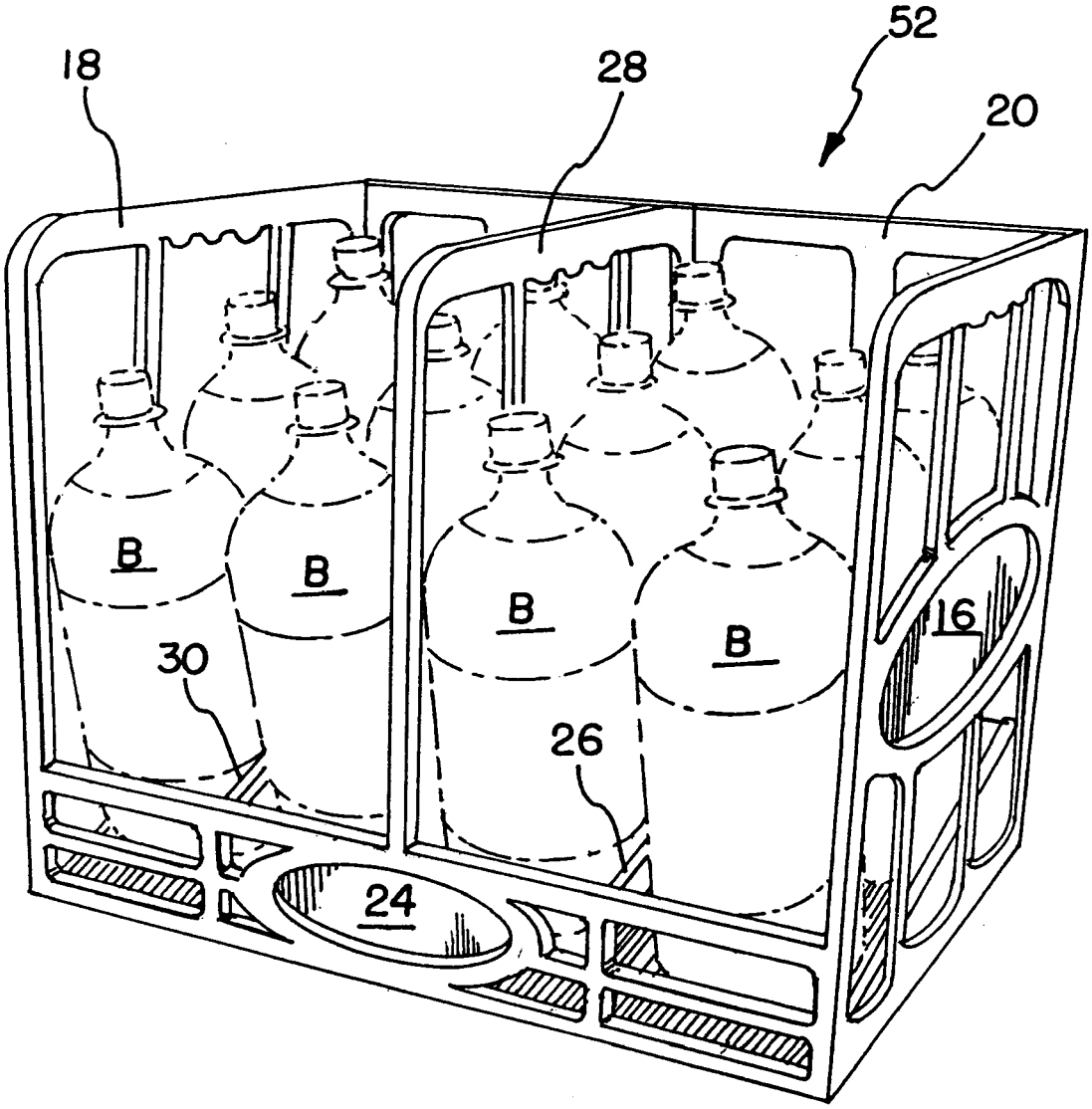
FIG. 5 is a top, right and front perspective view of a modified form of the shipping case shown in FIG. 2.

FIG. 5 illustrates a modified form 52 of the shipping case in FIGS. 2 and 3, wherein the upper front cross member is omitted. The parts of this case 52 corresponding to those of the shipping case 12 are designated by the like reference numerals, and descriptions of the corresponding parts are omitted. In this modified form, the lower edges of the side walls 16 and 18 may be formed with conventional locating means for engagement with complementary locating means at the upper edges of the side walls of a like case to allow stable stacking of the case 52 on the like case. An example of such locating means can be found in U.S. Pat. No. 5,452,803 which is hereby incorporated by reference.

It will be recognized that many variations may be made to the foregoing within the scope of the present invention. For example, the present invention is not limited to the cases composed of apertured walls such as shown in FIGS. 1–5 but may be those formed of walls with no aperture. Further, the case walls may be of a hollow construction, and preferably of a blow- or rotation-molded construction.

It should be also recognized that a separate front stopper may be provided for each track. Such a separate stopper may be a front wall element upstanding from the base wall or a pair of tabs transversely extending respectively from the associated pair of partitions or of a partition and a side wall.

It should be further recognized that a modular display rack of the invention is not limited to those such as shown in FIG. 1 assembled from a stack or stacks of cases wherein all the cases in each stack face in the same direction. Instead, the cases may be stacked one on another such that upper and lower adjacent cases face in opposite directions.

What is claimed is:

1. A stackable case for transport and merchandising of articles, comprising:

a plurality of case walls molded together to form a unitary crate structure having an open top and an open front for providing access to articles within said crate structure, said case walls including a base wall, a pair of opposed side walls, and a back wall, said base wall having an upper surface for providing a floor inclined downwardly to said open front so that articles slide thereon;

at least one partition upstanding from said base wall and defining, in cooperation with said side walls, a plurality of parallel tracks for receiving articles in rows, said tracks extending forward from said back wall so that articles in each of said tracks are carried by said floor and allowed to gravity feed toward said open front along said each track;

a front stopper provided at said open front for engagement with a leading article in said each track to prevent said leading article from falling out of said crate structure until removal thereof is desired;

stacking means for permitting stacking of said case on a lower adjacent like case, said stacking means comprising lower edges of said side walls arranged to cooperate with said lower adjacent like case; and an upper front cross member extending between said side walls, wherein a lower edge of said upper front cross member, front edges of said side walls and a top of said front stopper cooperatively define said open front through which articles may be removed from said crate structure.

2. The stackable case according to claim 1, wherein said floor is inclined with respect to a plane defined by lower edges of said side walls.

3. The stackable case according to claim 2, wherein each of said side walls are formed with a hand aperture to define a hand grip near an upper edge of said each side wall.

4. The stackable case according to claim 1, wherein said stacking means comprises upper and lower engaging means, said upper engaging means comprising upper edges of said side walls, said lower engaging means comprising said lower edges of said side walls, said lower edges being arranged to engage upper engaging means of said lower adjacent like case.

5. The stackable case according to claim 4, wherein said lower engaging means further comprises a pair of side ribs projecting downward respectively from said lower edges of said side walls to engage side walls of said lower adjacent like case, respectively.

6. The stackable case according to claim 4, further comprising an upper front cross member extending between said side walls, said upper engaging means further comprising an upper edge of said upper front cross member and an upper edge of said back wall.

7. The stackable case according to claim 6, wherein said lower engaging means further comprises a pair of front and rear ribs extending along front and rear edges of said base wall and projecting downward from said base wall to engage an upper front cross member and a back wall of said lower adjacent like case.

8. The stackable case according to claim 1, wherein said front stopper comprises a lower front cross member extending between said side walls.

9. The stackable case according to claim 8, wherein said at least one partition extends between said back wall and said lower front cross member.

10. The stackable case according to claim 8, wherein said at least one partition is of a vertical size less than the vertical size of said side walls.

11. The stackable case according to claim 1, wherein said back wall is formed with one or more rear openings for receiving portions of leading articles in a longitudinally adjacent like case placed behind said back wall in a front-to-back contacting relationship with said stackable case.

12. The stackable case according to claim 11, wherein the number of said rear openings corresponds to that of said tracks, and said rear openings are located at rear ends of said tracks respectively.

13. The stackable case according to claim 12, further comprising a plurality of rear arresting members joined to said back wall such that each of said arresting members transversely spans a respective one of said rear openings to engage said leading articles in said longitudinally adjacent like case.

14. The stackable case according to claim 13, wherein each of said rear arresting members is curved to conform to the shape of said leading articles in said longitudinally adjacent like case.

15. A combination comprising a shipping case and a plurality of upright articles accommodated in said shipping case, said shipping case, comprising:

a plurality of case walls molded together to form a unitary crate structure having an open top and an open front for providing access to said upright, said case walls including a base wall, a pair of opposed side walls, and a back wall, said base wall having an upper surface for providing a floor inclined downwardly to said open front so that said upright articles slide thereon, each of said side walls being of a vertical size substantially greater than the vertical size of said upright articles;

at least one partition upstanding from said base wall and defining, in cooperation with said side walls, a plurality of parallel tracks for receiving said upright articles in rows, said tracks extending forward from said back wall so that said upright articles in each of said tracks are carried by said floor and allowed to gravity feed toward said open front along said each track;

a front stopper provided at said open front for engagement with a leading article in said each track to prevent said leading article from falling out of said crate structure until removal thereof is desired; and means for permitting stacking of said case on a lower adjacent like shipping case, said stacking means comprising lower edges of said side walls arranged to cooperate with said lower adjacent like case.

16. The combination according to claim 15, further comprising an upper front cross member extending between said side walls, and a lower edge of said upper front cross member, front edges of said side walls and a top of said front stopper cooperatively define said open front through which said upright articles may be removed from said crate structure.

17. A modular merchandising device comprising a plurality of shipping cases stacked one on another to form a display rack, each of said shipping cases, comprising:

a plurality of case walls molded together to form a unitary crate structure having an open top and an open front for providing access to articles within said crate structure, said case walls including a base wall, a pair of opposed side walls, and a back wall, said base wall having an upper surface for providing a floor inclined downwardly to said open front so that articles slide thereon;

at least one partition upstanding from said base wall and defining, in cooperation with said side walls, a plurality of parallel tracks for receiving articles in rows, said tracks extending forward from said back wall so that articles in each of said tracks are carried by said floor and allowed to gravity feed toward said open front along said each track;

a front stopper provided at said open front for engagement with a leading article in said each track to prevent said leading article from falling out of said crate structure until removal thereof is desired; and means for permitting stacking of said each shipping case on a lower adjacent shipping case, said stacking means comprising lower edges of said side walls of said each shipping case arranged to cooperate with said side walls of said lower adjacent shipping case.

* * * * *